US009297328B2

(12) United States Patent
Klesse et al.

(10) Patent No.: US 9,297,328 B2
(45) Date of Patent: Mar. 29, 2016

(54) FUEL INJECTION SYSTEM OF AN INTERNAL COMBUSTION ENGINE, AND ASSOCIATED PRESSURE REGULATING METHOD

(75) Inventors: Christoph Klesse, Wörth A.D.Donau (DE); Hans Riepl, Hemau (DE); Wolfgang Stapf, Karlskron (DE); Tobias Ritsch, Dieterskirchen (DE); Uwe Lingener, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 315 days.

(21) Appl. No.: 13/977,819

(22) PCT Filed: Dec. 20, 2011

(86) PCT No.: PCT/EP2011/073424
§ 371 (c)(1),
(2), (4) Date: Jul. 1, 2013

(87) PCT Pub. No.: WO2012/089561
PCT Pub. Date: Jul. 5, 2012

(65) Prior Publication Data

US 2013/0291836 A1 Nov. 7, 2013

(30) Foreign Application Priority Data

Dec. 30, 2010 (DE) ..... 10 2010 064 374

(51) Int. Cl.
*F02M 41/00* (2006.01)
*F02D 41/30* (2006.01)
*F02D 41/38* (2006.01)

(52) U.S. Cl.
CPC ..... *F02D 41/3005* (2013.01); *F02D 41/3854* (2013.01); *F02D 2200/0602* (2013.01)

(58) Field of Classification Search
CPC ..... F02M 63/0225; F02M 63/024
USPC ..... 123/446–452, 455, 456, 457, 458, 461, 123/464, 510, 511
See application file for complete search history.

(56) References Cited

U.S. PATENT DOCUMENTS 6,230,688 B1 5/2001 Faix et al. ..... 123/495
6,722,857 B1 4/2004 Kellner et al. ..... 417/225
(Continued)

FOREIGN PATENT DOCUMENTS

DE 19926308 A1 12/2000 ..... F02M 37/04
DE 10148222 A1 4/2003 ..... F02D 41/20
(Continued)

OTHER PUBLICATIONS

International Search Report and Written Opinion, Application No. PCT/EP2011/073424, 14 pages, Apr. 25, 2012.

*Primary Examiner* — John Kwon
(74) *Attorney, Agent, or Firm* — Slayden Grubert Beard PLLC

(57) ABSTRACT

A fuel injection system of an internal combustion engine includes a first and a second fuel pump, a leakage-prone volume flow regulating valve arranged in a fuel line between the first and the second fuel pump, and a control unit configured to actuate the first fuel pump as a function of a position of the leakage-prone volume flow regulating valve, such that the leakage-prone volume flow regulating valve serves as the sole actuating element for pressure regulation in the fuel injection system. An associated pressure regulating method is also disclosed.

13 Claims, 5 Drawing Sheets

(56) References Cited

U.S. PATENT DOCUMENTS

| | | | | |
|---|---|---|---|---|
| 7,503,313 | B2 | 3/2009 | Achleitner et al. | 123/446 |
| 7,640,916 | B2 | 1/2010 | Ulrey et al. | 123/446 |
| 7,644,699 | B2 | 1/2010 | Wolber et al. | 123/447 |
| 7,827,966 | B2 | 11/2010 | Narisako et al. | 123/497 |
| 2006/0243244 | A1* | 11/2006 | Kasbauer et al. | 123/333 |
| 2006/0288984 | A1* | 12/2006 | Achleitner et al. | 123/447 |
| 2010/0049426 | A1* | 2/2010 | Jung et al. | 701/110 |
| 2010/0282214 | A1 | 11/2010 | Albrecht et al. | 123/457 |
| 2011/0126805 | A1* | 6/2011 | Klesse et al. | 123/463 |
| 2011/0223040 | A1 | 9/2011 | Lingener | 417/205 |

FOREIGN PATENT DOCUMENTS

| | | | | |
|---|---|---|---|---|
| DE | 102006061570 | A1 | 7/2008 | F02M 37/00 |
| DE | 102007050297 | A1 | 4/2009 | F02D 41/40 |
| DE | 102009004590 | A1 | 7/2009 | F02M 37/08 |
| DE | 102008047711 | A1 | 3/2010 | F02M 37/18 |
| DE | 102008059117 | A1 | 6/2010 | F02M 59/16 |
| EP | 1195514 | A2 | 4/2002 | F02B 67/00 |
| EP | 1281860 | A2 | 2/2003 | F02D 41/30 |
| EP | 1574704 | A2 | 9/2005 | F02D 41/38 |
| EP | 1794433 | A1 | 6/2007 | F02D 41/30 |
| WO | 2012/089561 | A1 | 7/2012 | F02D 41/38 |

* cited by examiner

FUEL INJECTION SYSTEM OF AN INTERNAL COMBUSTION ENGINE, AND ASSOCIATED PRESSURE REGULATING METHOD

CROSS-REFERENCE TO RELATED APPLICATIONS

This application is a U.S. National Stage Application of International Application No. PCT/EP2011/073424 filed Dec. 20, 2011, which designates the United States of America, and claims priority to DE Application No. 10 2010 064 374.2 filed Dec. 30, 2010, the contents of which are hereby incorporated by reference in their entirety.

TECHNICAL FIELD

The present disclosure relates to a fuel injection system of an internal combustion engine, to a pressure regulating method for a fuel injection system, to a control unit of a motor vehicle, and to a motor vehicle.

BACKGROUND

Fuel injection systems serve for the supply of fuel from a fuel tank of a motor vehicle to an internal combustion engine of the motor vehicle. By way of example, two known fuel injection systems will be explained on the basis of FIGS. 1 and 2.

The fuel injection systems shown in FIGS. 1 and 2 are common-rail fuel injection systems. FIG. 1 illustrates a so-called single-controller system, whereas FIG. 2 illustrates a so-called two-controller system.

Referring firstly to FIG. 1, a common-rail fuel injection system according to the prior art is denoted by the reference sign 1. The fuel injection system has a fuel tank 100 in which fuel is stored. The fuel is delivered out of the fuel tank 100 through a first fuel line 102 to a first fuel pump 104. The first fuel pump 104 is a mechanical pre-feed pump which is driven by a crankshaft 106 and which increases a fuel pressure downstream of the first fuel pump 104. A fuel filter 108 and a fuel temperature sensor 110 are arranged in the first fuel line 102.

From the first fuel pump 106, the fuel is conducted through a second fuel line 112 to a second fuel pump 114. The second fuel pump 114 is a mechanically driven high-pressure fuel pump. The second fuel pump 114 serves to further increase the fuel pressure in a region downstream of the second fuel pump 114. In FIG. 1, the second fuel pump 114 is driven by the crankshaft 106, in the same way as the first fuel pump 104. The region upstream of the second fuel pump 114 is referred to as low-pressure region. A ball-seat volume flow regulating valve 116 and a first check valve 118 are arranged in the second fuel line 112, wherein the first check valve 118 is arranged in the second fuel line 112 downstream of the ball-seat volume flow regulating valve 116. The ball-seat volume flow regulating valve 116 is characterized in that it exhibits no leakage in the closed state. The ball-seat volume flow regulating valve 116 is therefore a leakage-free volume flow regulating valve.

From the second fuel pump 114, the fuel is conducted via a third fuel line 120 into a high-pressure fuel accumulator (common rail) 122. A second check valve 124 and a first throttle 126 are arranged in the third fuel line 120. Furthermore, a fuel pressure sensor 128 is arranged on the high-pressure fuel accumulator 122 for the purpose of monitoring the fuel pressure in the high-pressure fuel accumulator 122.

Fuel from the high-pressure fuel accumulator 122 is conducted via a plurality of injector fuel lines 130 to a respective injector 132 of the internal combustion engine. Each injector fuel line 130 has an associated second throttle 134. Injector leakage from the respective injector 132 is supplied via an injector return line 136 back to the fuel tank 100, wherein a third check valve 138 is arranged in the injector return line 136.

For pressure regulation in the low-pressure region, a pressure regulating line 140 connects the second fuel line 112 to the first fuel line 102. A pressure regulating valve 142 is arranged in the pressure regulating line 140.

As a safety measure, in the high-pressure region, there is provided a high-pressure return line 144 which is connected at one end to the third fuel line 120 and at its other end to the return line 136. In the high-pressure return line 144 there is provided a pressure limiting valve 146 which, in the event of an inadmissibly high fuel pressure in the high-pressure region, permits a return flow of fuel into the fuel tank 100.

Lubrication of the second fuel pump 114 is realized via a lubricant fuel line 148 which is connected at one end to the second fuel line 112 and at its other end to a lubricant inlet of the second fuel pump 114. In the lubricant fuel line 148 there are arranged, in the downstream direction, a third throttle 150 and a fourth check valve 152. The fuel used for the lubrication of the second fuel pump 114 exits the second fuel pump 114 via a lubricant return line 154, which opens out into the high-pressure pump return line and into the return line 136. From there, the fuel flows back into the fuel tank 100.

As already mentioned in the introduction, the injection system 1 described in accordance with FIG. 1 is a so-called single-controller system. In said type of system, the fuel pressure in the fuel injection system is regulated exclusively by means of one volume flow regulating valve. In the embodiment illustrated here, this is a leakage-free ball-seat volume flow regulating valve.

A disadvantage of single-controller systems is that only volume flow regulating valves that exhibit no leakage or little leakage can be used. This will be explained in more detail below with reference to FIG. 2. Furthermore, the use of leakage-free volume flow regulating valves, in particular of ball-seat volume flow regulating valves, is cost-intensive owing to their expensive production.

Another form of a known injection system is denoted in FIG. 2 by the reference sign 2. The fuel injection system 2 has a fuel tank 200 in which fuel is stored. In the fuel tank 200 there is arranged a first fuel pump 202 which is electrically operated and which increases a fuel pressure downstream of the first fuel pump 202. The first fuel pump 202 normally runs continuously in an unchanging manner.

By means of the first fuel pump 202, fuel is delivered out of the fuel tank 200 via a first fuel line 204 to a second fuel pump 206. The second fuel pump 206 is a mechanically operated high-pressure fuel pump which serves to further increase the fuel pressure in a region downstream of the second fuel pump 206. The region between the first fuel pump 202 and the second fuel pump 206 is referred to as low-pressure region. In the first fuel line 204 there are arranged, in a downstream direction, a fuel filter 208, a fuel temperature sensor 210, a slide-type volume flow regulating valve 212, and a first check valve 214. The slide-type volume flow regulating valve 212 exhibits leakage in the closed state, that is to say is leakage-prone.

From the second fuel pump 206, the fuel is conducted via a second fuel line 216 into a high-pressure fuel accumulator (common rail) 218. A second check valve 220 and a first throttle 222 are arranged in the second fuel line 216. Furthermore, a fuel pressure sensor 224 is arranged on the high-pressure fuel accumulator 218 for the purpose of monitoring the fuel pressure in the high-pressure fuel accumulator 218.

Fuel from the high-pressure fuel accumulator 218 is conducted via a plurality of injector fuel lines 226 to a respective injector 228 of the internal combustion engine. Injector leakage from the respective injector 228 is supplied back to the fuel tank 200 via an injector return line 230.

A pressure regulating valve 232 for active pressure regulation is provided in the high-pressure region between the second fuel pump 206 and the injectors 228. The pressure regulating valve 232 is arranged in a line 234 which connects the high-pressure fuel accumulator 218 to the first fuel line 204 between the fuel filter 208 and the first fuel pump 202.

For pressure stability in the low-pressure region upstream of the VCV, a low-pressure return line 236 is provided which is connected at one end to the second fuel pump 206, and via the latter to the low-pressure circuit via the line 240 and the throttle 142, and at its other end to the injector return line 230. In the low-pressure return line 236 there is provided a pressure limiting valve 238 which permits a return flow of fuel into the fuel tank 200.

Lubrication of the second fuel pump 206 is realized via a lubricant fuel line 240 which is connected at one end to the first fuel line 204 and at its other end to a lubricant inlet of the second fuel pump 206. A second throttle 242 is arranged in the lubricant fuel line 240. The fuel used for the lubrication of the second fuel pump 206 exits the second fuel pump 206 via a lubricant return line 244, in which a third throttle 246 is arranged. The lubricant return line 244 opens out into the low-pressure return line 236. From there, the fuel flows back into the fuel tank 200.

Here, regulation of the fuel pressure is realized firstly by means of the slide-type volume flow regulating valve 212 in the low-pressure region, and secondly by means of the pressure-regulating valve 232 in the high-pressure region. Here, the pressure regulating valve 232 actively regulates the fuel pressure in the fuel injection system 2. Said system type is therefore a so-called two-controller system.

The use of two control elements in a fuel injection system having a slide-type volume flow regulating valve is necessary because a mass-produced slide-type volume flow regulating valve exhibits leakage in the closed state. It is therefore the case that in particular small delivery rates of the high-pressure fuel pump cannot be regulated with sufficient accuracy. In particular, even if the slide-type volume flow regulating valve is actuated at 0% in the case of a normally-closed valve or at 100% in the case of a normally-open valve, leakage occurs into a pump chamber of the high-pressure fuel pump or of the second fuel pump. Said leakage is inherent and cannot be prevented in mass production. The leakage behavior has the effect that, even in the case of a closed volume flow regulating valve, fuel continues to be supplied to the high-pressure fuel pump, and the fuel pressure in the high-pressure region is further increased. There is therefore the need for an additional pressure regulation valve to be provided in the high-pressure region in the fuel injection system in order to regulate the high pressure with the required accuracy.

A disadvantage of the two-controller system is thus the need for two control elements for pressure regulation in a fuel injection system. This leads to increased regulation outlay in relation to the single-controller system. Furthermore, said system is also cost-intensive because two control elements and the associated regulation means are required.

DE 10 2008 059 117 A1 discloses a high-pressure pump arrangement. The high-pressure pump arrangement has a pump body which comprises a low-pressure inlet and a high-pressure outlet. Within the pump body there is provided a pressure build-up chamber within which a plunger is mounted in a movable manner and which is connected via a high-pressure valve to the high-pressure outlet. Furthermore, within the pump body, there is provided a suction chamber which is provided with a suction valve. Furthermore, within the pump body, there is provided a suction duct which runs between the low-pressure inlet and the suction chamber. The low-pressure inlet is connected to an electrically regulable pre-feed pump, which is always operated such that a negative pressure is ensured in the suction chamber of the pump. The regulation of the fuel pressure in the fuel injection system is realized by means of a high-pressure regulating valve.

EP 1 195 514 A2 describes a device for controlling the flow from a high-pressure pump into a common-rail fuel injection system of an internal combustion engine. The common rail provides a supply to a number of injectors of the cylinders of the internal combustion engine, and has a supply provided to it by a high-pressure pump, which in turn has a supply provided to it by a motor-driven variable low-pressure pump. The control device has an electronic control unit for receiving signals which indicate the operating state of the internal combustion engine. The suction side of the high-pressure pump has a throttle. The control unit controls the motor-driven low-pressure pump in order to vary the fuel pressure upstream of the throttle between a predetermined maximum value and a predetermined minimum value, in order thereby to regulate the fuel intake of the high-pressure pump within a predetermined range. For pressure regulation, the device also has a pressure regulating valve in the high-pressure region. Likewise, a pressure sensor in the low-pressure region is used for monitoring the fuel pressure in the low-pressure region.

A further method for generating high fuel pressure, and a corresponding system, are described in U.S. Pat. No. 6,230,688 B1. The system comprises a low-pressure pump as a pre-feed pump, by means of which fuel is sucked from a tank and delivered to the inlet side of a high-pressure pump. A part of the fuel supplied by the low-pressure pump is used for the lubrication of the high-pressure pump, wherein a volume flow regulating valve is used for regulation, and a low-pressure sensor is provided in the supply line.

Likewise, EP 1 574 704 A2 describes a further fuel injection system having an electric low-pressure pump. A control means of a fuel injection system regulates an amount of energy of an electric motor in accordance with a sensor signal output by a common-rail pressure sensor means. In this way, the control means control a fuel supply rate of the low-pressure pump. In this way, the power consumption of the electric motor which drives the low-pressure pump can be regulated in accordance with a pressure supply rate of a high-pressure pump. Furthermore, a pressure sensor in the low-pressure region of the fuel injection system is used for monitoring the fuel supply pressure of the low-pressure pump.

A suction pump system for a fuel direct injection system is described in DE 10 2009 004 590 A1. The fuel injection system has a fuel suction pump which supplies fuel to an injection pump. Furthermore, the fuel injection system comprises an accumulator arranged between the outlet of the suction pump and the inlet of the injection pump, and also a control unit which adapts the energy supplied to the suction pump such that a pressure at the inlet of the injection pump lies above a first predetermined value. The control unit shuts off the energy supplied to the first fuel pump if the pressure at the inlet of the injection pump is higher than a second predetermined value.

DE 10 2006 061 570 A1 describes a further fuel system for an internal combustion engine. The fuel system comprises a first fuel pump and a pressure region into which the fuel pump delivers and which is connected to an elastic volume accumulator. Said volume accumulator has a pressure/volume characteristic curve defined by at least two points. A first point is defined by a first volume at a first pressure which is slightly higher than a vapor pressure of the fuel at ambient temperature, and a second point is defined by a second volume and a second pressure in the pressure range corresponding to a maximum pressure. The difference between the first and the second volume corresponds at least approximately and at least to a value by which the volume of the fuel in the pressure region decreases during cooling from a maximum temperature to ambient temperature.

A disadvantage of the fuel injection systems specified above is firstly the required number of components and the resulting complex control. A further disadvantage is the costs that arise therefrom during the use of such fuel injection systems.

SUMMARY

One embodiment provides a fuel injection system of an internal combustion engine, comprising: a) a first and a second fuel pump, b) a leakage-prone volume flow regulating valve which is arranged in a fuel line between the first and the second fuel pump, and c) a control unit by means of which the first fuel pump can be actuated as a function of a position of the leakage-prone volume flow regulating valve, such that the leakage-prone volume flow regulating valve serves as the sole control element for a fuel pressure regulation in the fuel injection system.

In a further embodiment, the leakage-prone volume flow regulating valve is a slide-type volume flow regulating valve.

In a further embodiment, the first fuel pump is an electric pre-feed pump, in particular an in-tank pump.

In a further embodiment, lubrication of the second fuel pump is realized by means of an engine oil of the internal combustion engine, in particular, the second fuel pump is a plug-in pump with engine oil lubrication.

In a further embodiment, the first fuel pump can be actuated by the control unit as a function of an operating state of the internal combustion engine.

In a further embodiment, said fuel injection system also having a fuel pressure sensor downstream of the second fuel pump and/or a fuel temperature sensor, such that the first fuel pump can be actuated by the control unit as a function of a fuel pressure that can be detected by means of the fuel pressure sensor and/or as a function of a fuel temperature that can be detected by means of the fuel temperature sensor.

Another embodiment provides a pressure regulating method for a fuel injection system as disclosed above, wherein the pressure regulating method has the following steps: a) detection of a position of the leakage-prone volume flow regulating valve, and b) actuation of the first fuel pump as a function of the detected position of the leakage-prone volume flow regulating valve, wherein the leakage-prone volume flow regulating valve serves as the sole control element for a fuel pressure regulation in the fuel injection system.

In a further embodiment, the actuation of the first fuel pump takes place in the form of time-dependent "toggle" switching.

In a further embodiment, pressure regulating method has the further step: c) detection of an operating state of the internal combustion engine, wherein the detected operating state of the internal combustion engine is taken into consideration in the actuation of the first fuel pump.

In a further embodiment, the actuation of the first fuel pump takes place in such a way that the first fuel pump is deactivated if the detected operating state of the internal combustion engine corresponds to a first predefinable operating state, and is activated if the detected operating state of the internal combustion engine corresponds to a second predefinable operating state.

In a further embodiment, the pressure regulating method also has the step: d) detection of a fuel pressure downstream of the second fuel pump, wherein the detected fuel pressure is taken into consideration in the actuation of the first fuel pump.

In a further embodiment, the actuation of the first fuel pump takes place in such a way that the first fuel pump is deactivated if a first predefinable pressure threshold value is overshot, and is activated if a second predefinable pressure threshold value is undershot.

In a further embodiment, the pressure regulating method has the further step: e) detection of a fuel temperature in the fuel injection system, wherein the detected fuel temperature is taken into consideration in the actuation of the first fuel pump.

Another embodiment provides a control unit of a motor vehicle, which control unit is configured to perform any of the pressure regulating methods or steps disclosed above.

Another embodiment provides a motor vehicle having an internal combustion engine having any of the fuel injection systems and/or the control unit disclosed above.

BRIEF DESCRIPTION OF THE DRAWINGS

Example embodiments of the present invention are described in detail below with reference to the drawings, in which.

DETAILED DESCRIPTION

Figure 1:
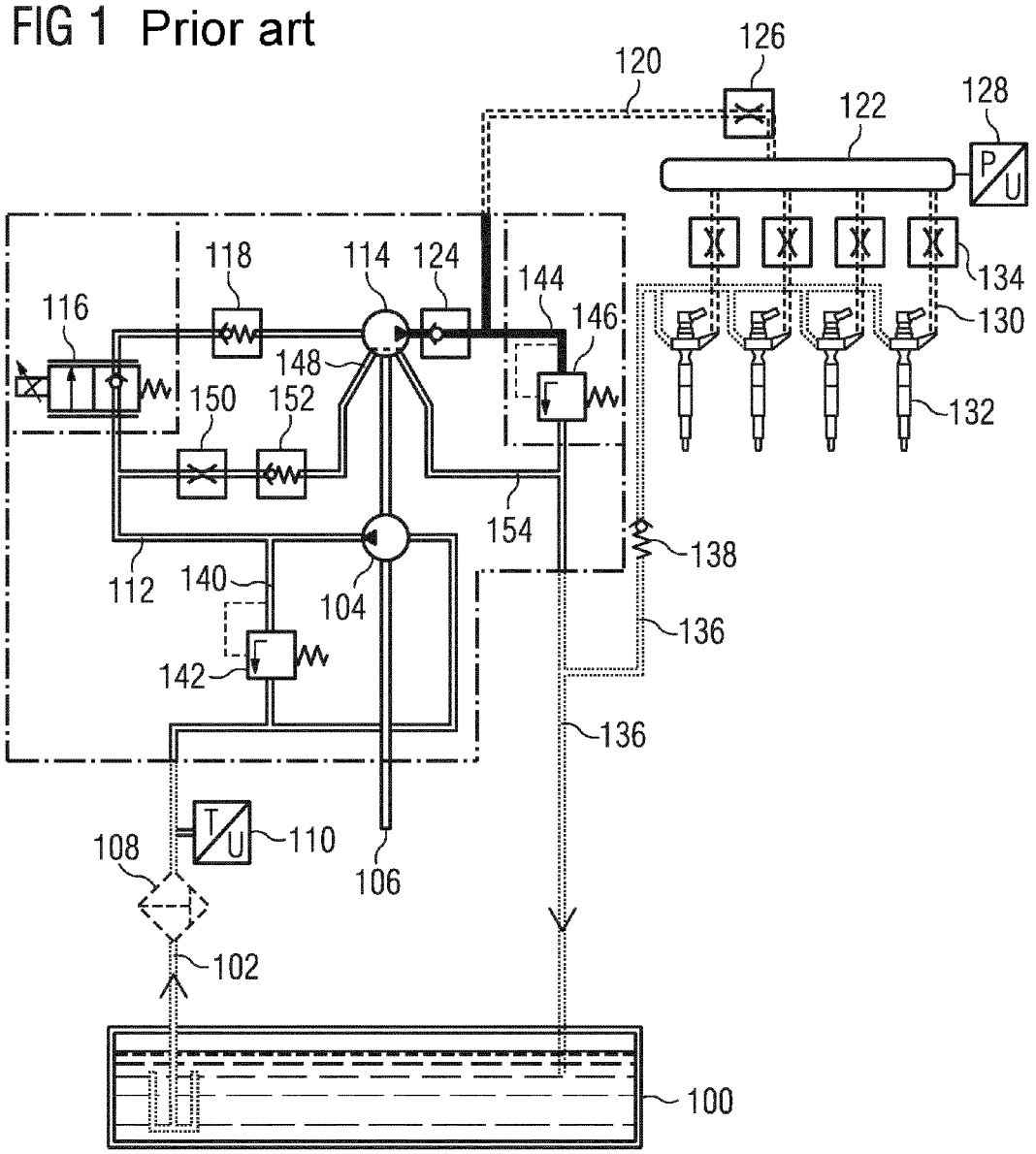
FIG 1 Prior art
FIG. 1 is a hydraulic circuit diagram of a common-rail fuel injection system having a ball-seat volume flow regulating valve according to the prior art.
Figure 2:
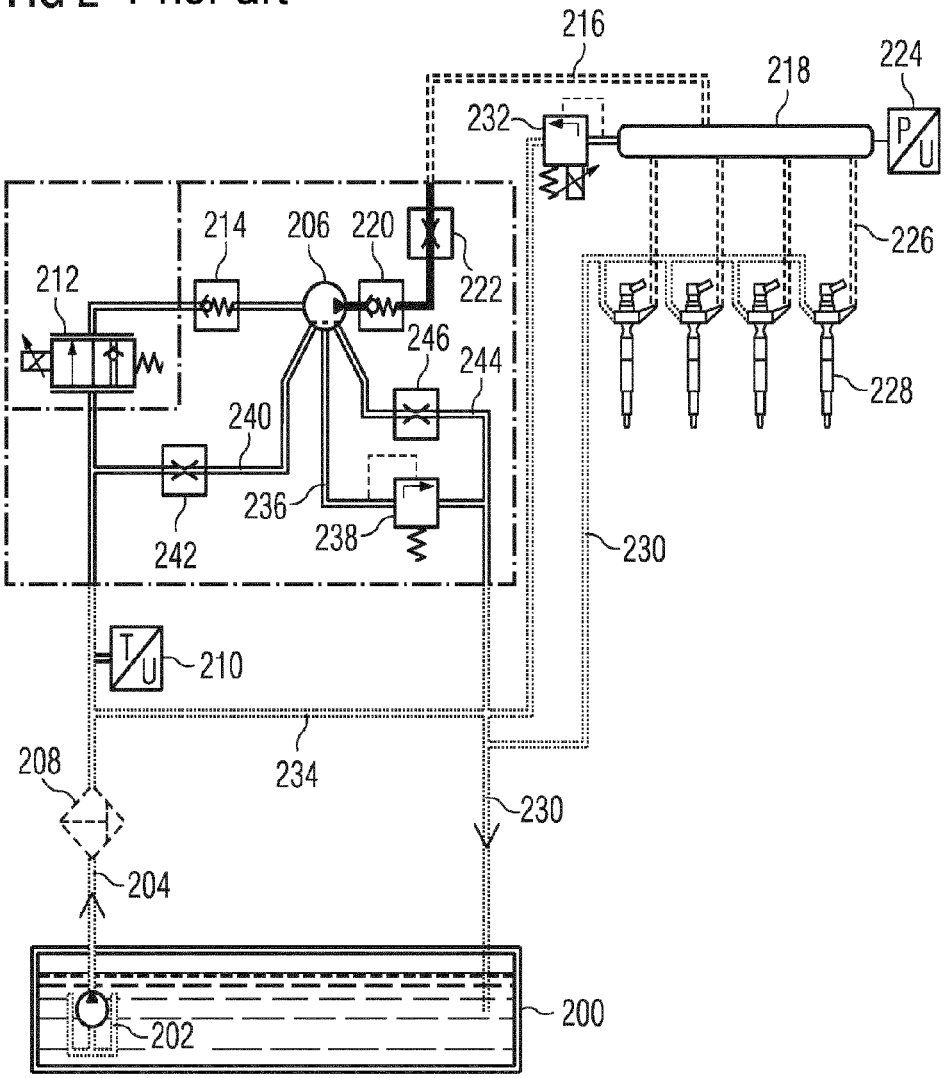
FIG 2 Prior art
FIG. 2 is a hydraulic circuit diagram of a common-rail fuel injection system with a slide-type volume flow regulating valve and an additional pressure regulating valve according to the prior art.

Embodiments of the present invention may provide an improved fuel injection system with regard to the required number of components, and a corresponding pressure regulating method.

In some embodiments, a fuel injection system of an internal combustion engine comprises a first and a second fuel pump, a leakage-prone volume flow regulating valve which is arranged in a fuel line between the first and the second fuel pump, and a control unit by means of which the first fuel pump can be actuated as a function of a position of the leakage-prone volume flow regulating valve, such that the leakage-prone volume flow regulating valve serves as the sole control element for a fuel pressure regulation in the fuel injection system. In the case of the invention, a low-pressure sensor in the fuel line is not necessary and is also not provided.

By means of the first fuel pump, fuel is pumped out of a fuel tank via a first fuel line to the second fuel pump. The first fuel pump is preferably an electric pre-feed pump, in particular an in-tank pump. The region between the first and the second fuel pump is referred to as low-pressure region. From the second fuel pump, the fuel is conducted to at least one injector of the internal combustion engine. The region between the second fuel pump and the at least one injector is referred to as high-pressure region.

The fuel injection system is preferably a common-rail fuel injection system. In this case, a high-pressure fuel accumulator (common rail) is arranged between the second fuel pump and the at least one injector.

The fuel injection system has, as the sole control element for fuel pressure regulation in the fuel injection system, a leakage-prone volume flow regulating valve in the low-pressure region. In particular, no pressure regulating valve is required in the high-pressure region.

The leakage-prone volume flow regulating valve exhibits leakage in the closed state, as already explained above. The leakage-prone volume flow regulating valve is preferably a slide-type volume flow regulating valve. A closed state of the leakage-prone volume flow regulating valve normally arises if low injection quantities are required, for example when the engine is at idle or in an overrun mode.

If a closed position of the leakage-prone volume flow regulating valve is now detected, for example by means of a check of the actuation signal in the control unit for the leakage-prone volume flow regulating valve, then the first fuel pump may be deactivated completely for said period of time. Alternatively, the first fuel pump may be actuated on the basis of time-controlled interval switching, in particular "toggle" switching. In the case of "toggle" switching, the first fuel pump is merely switched alternately on and off, without any other variations in the actuation. No low-pressure sensor is required for the actuation of the first fuel pump.

In this way, the fuel pressure acting on the leakage-prone volume flow regulating valve or the fuel pressure difference is adapted as a function of the position of the volume flow regulating valve by means of corresponding actuation of the first fuel pump. In this way, the first fuel pump can be actuated in such a way that the leakage is reduced or eliminated by a reduction of the prevailing fuel pressure or the prevailing fuel pressure difference. In other words, the fuel pressure upstream of the leakage-prone volume flow regulating valve is reduced according to demand on the basis of the regulated actuation of the first fuel pump. Aside from the position of the volume flow regulating valve, as further parameters for the regulated actuation, use may be made of the fuel temperature and the fuel pressure in the high-pressure region, as will be discussed in more detail further below. Zero leakage of the volume flow regulating valve is advantageously achieved on the basis of the actuation of the first fuel pump.

Therefore, pressure regulation in the fuel injection system can be realized exclusively through the use of a volume flow regulating valve which is prone to leakage in the closed state, without the use of an additional pressure regulating valve. Further statements with regard to the operation of the fuel injection system with a leakage-prone volume flow regulating valve as the sole control element for pressure regulation will be made further below with reference to the associated pressure regulating method.

Owing to the capability for using leakage-prone volume flow regulating valves as the sole control element for pressure regulation, it is advantageously the case that a reduced number of components is required in relation to the prior art. A further advantage is that an actuation of the fuel injection system is simplified. Furthermore, the leakage-prone volume flow regulating valves exhibit lower production costs than leakage-free volume flow regulating valves, whereby, as a further advantage, a cost advantage in relation to the prior art is attained.

In one embodiment, the lubrication of the second fuel pump is realized by means of an engine oil of the internal combustion engine. In particular, the second fuel pump is a plug-in pump with engine oil lubrication. In said fuel pump type, a scavenging oil stream of the high-pressure pump is not influenced by a deactivation of the first fuel pump. Therefore, a deactivation of the first fuel pump does not have any adverse effect on the lubrication of the second fuel pump.

In a further embodiment, the first fuel pump can be actuated by the control unit as a function of an operating state of the internal combustion engine. As discussed above, the leakage behavior of the leakage-prone volume flow regulating valve has a particularly pronounced effect at low fuel injection rates. Low injection rates in relation to full-load operation of the internal combustion engine arise during overrun operation or during idle operation of the internal combustion engine. For example, the first fuel pump may be completely deactivated, or switched in a time-controlled manner by means of interval switching, during an overrun phase or an idle phase.

It may also be preferable for the fuel injection system to have a fuel pressure sensor downstream of the second fuel pump and/or a fuel temperature sensor, such that the first fuel pump can be actuated by the control unit as a function of a fuel pressure that can be detected by means of the fuel pressure sensor and/or as a function of a fuel temperature that can be detected by means of the fuel temperature sensor. The fuel temperature plays a role in the determination of the internal leakage of the leakage-prone volume flow regulating valve. The fuel temperature sensor thus serves to further improve the actuation of the first fuel pump. The fuel temperature sensor is preferably arranged adjacent to the volume flow regulating valve. An additional low-pressure sensor arrangement is not required. By contrast, the fuel pressure sensor is arranged in the high-pressure region. The fuel pressure sensor may be used for checking a fuel pressure in the high-pressure region, for example in order that the first fuel pump can be actuated such that the fuel pressure does not rise above a first predefinable threshold value or fall below a second predefinable threshold value.

A pressure regulating method of a fuel injection system may include the following steps: detection of a position of the leakage-prone volume flow regulating valve and actuation of the first fuel pump as a function of the detected position of the leakage-prone volume flow regulating valve, wherein the leakage-prone volume flow regulating valve serves as the sole control element for a fuel pressure regulation in the fuel injection system.

The pressure regulating method may provide the advantages of the disclosed fuel injection system. In the pressure regulating method, the position of the leakage-prone volume flow regulating valve is firstly detected. This may be realized for example by means of a check of corresponding actuation parameters in the associated control unit. If a closed position of the leakage-prone volume flow regulating valve is detected, then the first fuel pump is for example deactivated or activated by means of time-controlled interval switching, in particular "toggle" switching. In this way, the fuel pressure upstream of the volume flow regulating valve is reduced, whereby leakage of the volume flow regulating valve can be reduced or eliminated. As a result, the second fuel pump does not have any undesired delivery action and the fuel pressure in the high-pressure region is not increased in an undesired manner. An additional sensor arrangement such as, for example, a low-pressure sensor arrangement is not required.

In one embodiment, the actuation of the first fuel pump takes place in the form of "toggle" switching. The first fuel pump is normally in an activated state, without variation of the actuation. Said state is denoted by 1. By contrast, there is a second state of the first fuel pump in which said first fuel pump is deactivated. Said state is denoted by 0. In the case of the "toggle" switching discussed above, the first fuel pump is switched alternately back and forth between state 1 and state 0. The switching may take place in a time-controlled manner. Regulation of the first fuel pump is not provided in any other regard.

It may likewise be preferable for the pressure regulating method to have the further step: detection of an operating state of the internal combustion engine, wherein the detected operating state of the internal combustion engine is taken into consideration in the actuation of the first fuel pump. In particular, the detected operating state of the internal combustion engine is taken into consideration in the actuation of the first fuel pump in such a way that the actuation of the first fuel pump takes place in such a way that the first fuel pump is deactivated if the detected operating state of the internal combustion engine corresponds to a first predefinable operating state, and is activated if the detected operating state of the internal combustion engine corresponds to a second predefinable operating state. The first predefinable operating state is for example an overrun mode or an idle mode of the internal combustion engine. If, for example, the internal combustion engine was previously in a full-load mode, then the fuel pressure in the high-pressure accumulator will normally be depleted in this case. A further delivery of fuel into the high-pressure fuel accumulator is therefore undesirable. In this case, the first fuel pump may remain deactivated until the operating state of the internal combustion engine changes. In this case, a change means that the internal combustion engine switches from the overrun phase or the overrun mode or from the idle phase or the idle mode into a load phase such as full load or part load.

In a further embodiment, the pressure regulating method has the step: detection of a fuel pressure in a fuel line downstream of the second fuel pump, wherein the detected fuel pressure in the high-pressure accumulator is taken into consideration in the actuation of the first fuel pump.

In particular, in this case, the consideration in the actuation of the first fuel pump takes place in such a way that the first fuel pump is deactivated if a first predefinable pressure threshold value in the high-pressure fuel accumulator is overshot, and is activated if a second predefinable pressure threshold value in the high-pressure fuel accumulator is undershot.

Optionally, the detection of the operating state of the internal combustion engine may be combined with the detection of the fuel pressure in the high-pressure region. In this case, there are then, in addition to the position of the volume flow regulating valve, two conditions for an activation and two conditions for a deactivation of the first fuel pump. The disclosed pressure regulating method can be further improved in this way.

It may furthermore be advantageous for the pressure regulating method to have the further step: detection of a fuel temperature in the fuel injection system, wherein the detected fuel temperature is taken into consideration in the actuation of the first fuel pump. The fuel temperature has an effect on the leakage behavior of the volume flow regulating valve in the closed state. By taking into consideration the fuel temperature detected by the fuel temperature sensor, a leakage behavior of the volume flow regulating valve can be determined with greater accuracy. It is thus possible in turn for the actuation of the first fuel pump to be improved.

Other embodiments provide a control unit of a motor vehicle that is configured to perform the pressure regulating method disclosed herein. The control unit may thus provide all of the advantages of the disclosed pressure regulating method, which will not be discussed again at this juncture.

Other embodiments provide a motor vehicle having an internal combustion engine including the fuel injection system and/or control unit disclosed herein. The motor vehicle may thus likewise provide all of the advantages of the fuel injection system and/or control unit. The motor vehicle may be a motor vehicle with an internal combustion engine and an associated common-rail fuel injection system.

A motor vehicle having an internal combustion engine has a control unit and a fuel injection system. Accordingly, the fuel injection system is preferably a common-rail fuel injection system. The fuel injection system has a leakage-prone volume flow regulating valve, in particular a leakage-prone slide-type volume flow regulating valve.

A leakage volume flow $Q_{leak}$ of the slide-type volume flow regulating valve can be calculated in accordance with the following equation:

$$Q_{leak} = \frac{\pi D h^3}{12\mu l}\Delta P\left(1 + \frac{3}{2}\left(\frac{e}{h}\right)^2\right).$$

Here, D is the valve diameter in m, h is the size of the gap in m, μ is the viscosity coefficient in Pa·s, l is the length of the seal in m, and e is the magnitude of the eccentricity in m.

Figure 3:
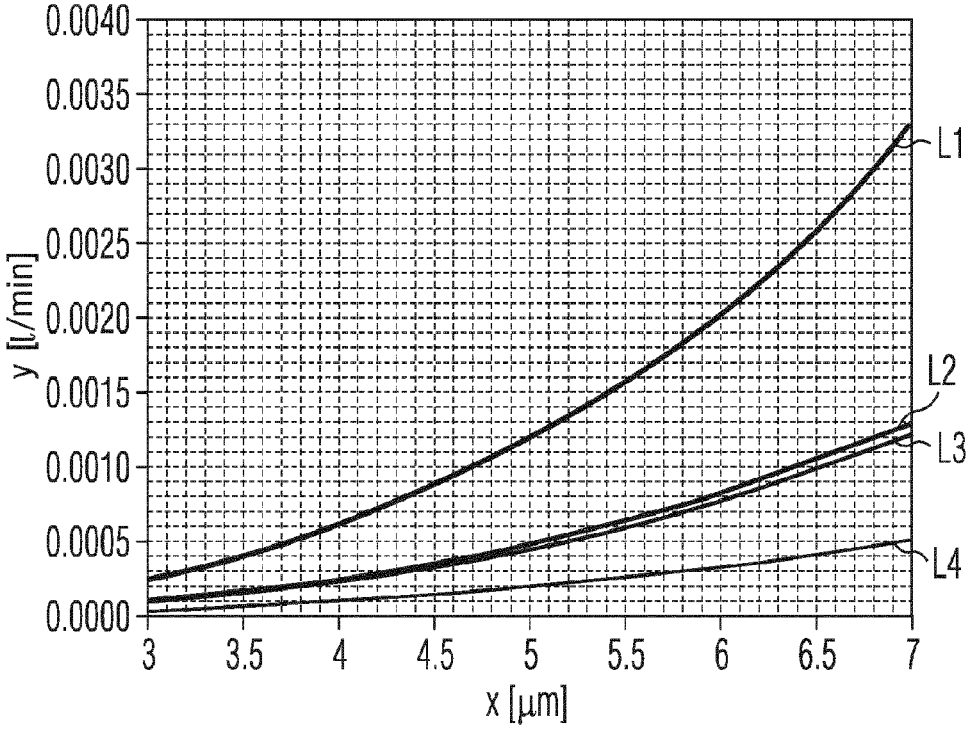
FIG. 3 is an illustration of the leakage of a closed slide-type volume flow regulating valve as a function of the valve gap at a defined constant fuel temperature.

FIG. 3 shows an illustration of the leakage of a closed slide-type volume flow regulating valve as a function of the valve gap at a defined constant fuel temperature and at a certain pressure difference across the valve. The size of the valve gap s in urn is plotted on the x axis and the leakage L in liters per minute is plotted on the y axis.

The leakage of the leakage-prone volume flow regulating valve is dependent primarily on the fuel pressure prevailing at the volume flow regulating valve or on the prevailing fuel pressure difference and on the fuel temperature. With decreasing fuel pressure or with decreasing fuel pressure difference and decreasing fuel temperature, the leakage of the volume flow regulating valve in the closed state decreases.

Referring again to FIG. 3, the line L1 represents a worst-case leakage behavior of a slide-type volume flow regulating valve at a pressure difference of 10 bar and a fuel temperature of in this case 40° C. The line L3 represents the associated best case at a fuel pressure of 10 bar. Also illustrated is both the worst case and also the best case for a fuel pressure of 4 bar and a fuel temperature of in this case 40° C. Here, the worst case is represented by line L2, and the best case is represented by line L4.

Figure 4:
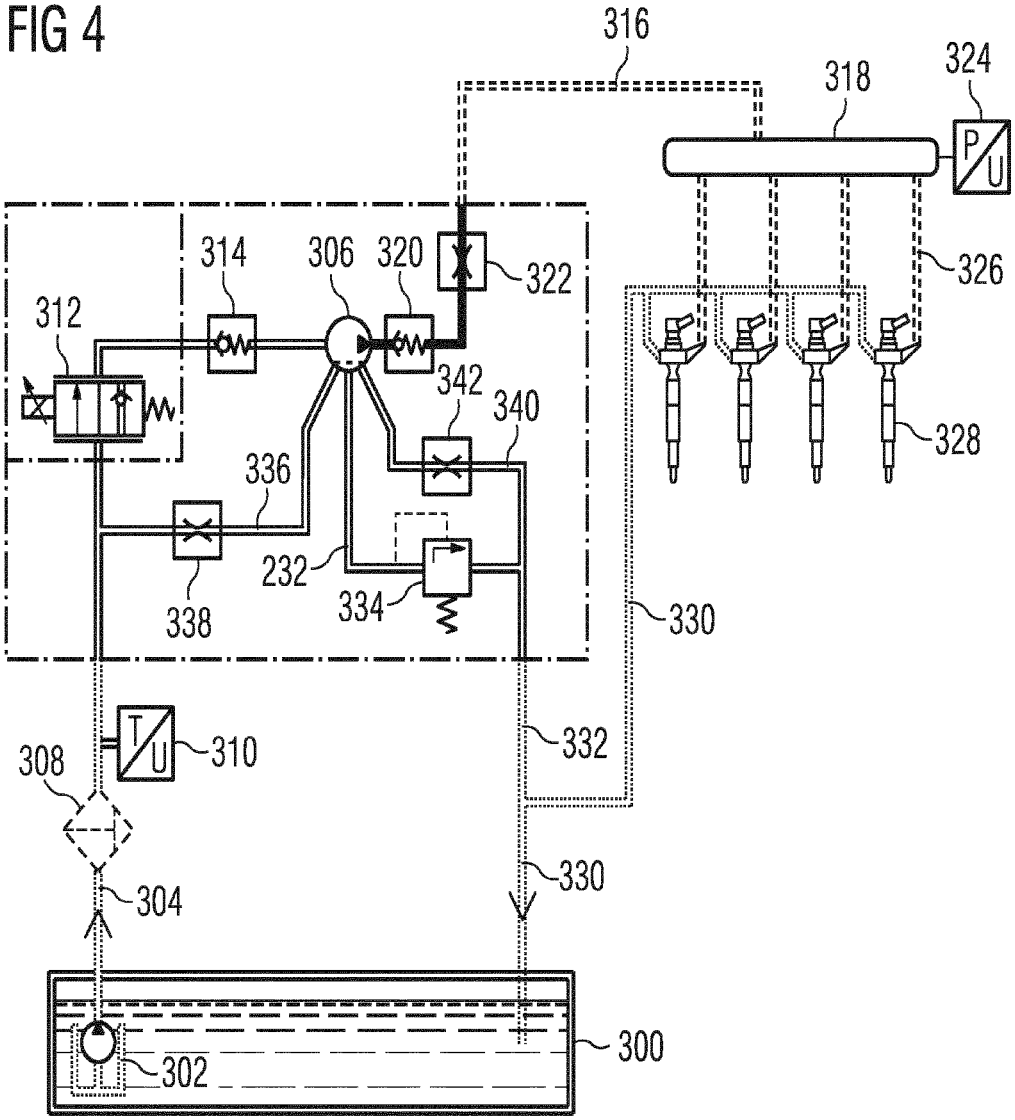
FIG. 4 is a hydraulic circuit diagram of a common-rail fuel injection system having a slide-type volume flow regulating valve according to one embodiment of the present invention.

FIG. 4 shows a common-rail fuel injection system 3 according to one embodiment. The fuel injection system 3 has a fuel tank 300 in which fuel is provided. In the fuel tank 300 is arranged a first fuel pump 302 which is electrically operated and which increases a fuel pressure downstream of the first fuel pump 302. The first fuel pump 302 is therefore an electric pre-feed pump, in particular an in-tank pump.

By means of the first fuel pump 302, fuel is delivered out of the fuel tank 300 via a first fuel line 304 to a second fuel pump 306. The second fuel pump 306 is a mechanically operated high-pressure fuel pump which serves to further increase the fuel pressure in a region downstream of the second fuel pump 306. The region between the first fuel pump 302 and the second fuel pump 306 is referred to as low-pressure region. In the first fuel line 304 there are arranged, in a downstream direction, a fuel filter 308, a fuel temperature sensor 310, a leakage-prone slide-type volume flow regulating valve 312, and a first check valve 314. A pressure sensor in the low-pressure region is not provided, and is not required for the disclosed pressure regulating method.

From the second fuel pump 306, the fuel is conducted via a second fuel line 316 into a high-pressure fuel accumulator (common rail) 318. In the second fuel line 316 there are arranged a second check valve 320 and optionally a first throttle 322. Furthermore, on the high-pressure fuel accumulator 318, there is arranged a fuel pressure sensor 324 for monitoring the fuel pressure in the high-pressure fuel accumulator 318. A pressure regulating valve is not provided in the high-pressure region between the second fuel pump 306 and the injectors 328, and is not required for the disclosed pressure regulating method.

Fuel from the high-pressure fuel accumulator 318 is conducted via a plurality of injector fuel lines 326 to a respective injector 328 of the internal combustion engine. Injector leakage from the respective injector 328 is supplied back to the fuel tank 300 via an injector return line 330.

For pressure stability upstream of the volume flow regulating valve in the low-pressure region, there is optionally provided a low-pressure return line 332 which is connected at one end to the second fuel pump 306 and at its other end to the injector return line 330. In the low-pressure return line 332 there is optionally provided a pressure limiting valve 334 which, in the event of an inadmissibly high fuel pressure, permits a return flow of fuel into the fuel tank 300.

Lubrication of the second fuel pump 306 is realized via a lubricant fuel line 336 which is connected at one end to the first fuel line 304 and at its other end to a lubricant inlet of the second fuel pump 306. A second throttle 338 is optionally arranged in the lubricant fuel line 336. The fuel used for the lubrication of the second fuel pump 306 exits the second fuel pump 306 via a lubricant return line 340, in which a third throttle 342 is optionally arranged. The lubricant return line 340 opens out into the low-pressure return line 332. From there, the fuel flows back into the fuel tank 300.

As an alternative to the lubrication of the second fuel pump 306 by means of fuel, the lubrication of the second fuel pump 306 may be realized by means of an engine oil of the internal combustion engine. In this case, the second fuel pump has no scavenging oil path. Here, the second fuel pump may be arranged on a camshaft of the internal combustion engine or mounted on a housing and lubricated by the engine oil. Since the lubrication of the second fuel pump takes place not with fuel but rather with engine oil, a deactivation of the first fuel pump 302 does not lead to the lubrication of the second fuel pump 312 being influenced.

Figure 5:
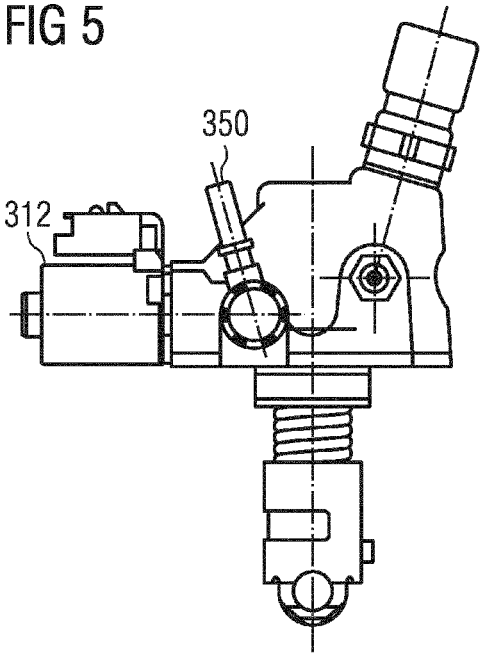
FIG. 5 shows a high-pressure pump without scavenging oil path (so-called plug-in pump)

FIG. 5 shows an embodiment of the second fuel pump 30 6. Said second fuel pump is in this case a plug-in pump without scavenging oil path. The leakage-prone volume flow regulating valve 312 is arranged on the second fuel pump 306, and the second fuel pump 306 has an inlet 350 for fuel.

Figure 6:
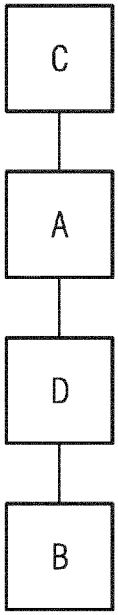
FIG. 6 shows a schematic sequence of an embodiment of the pressure regulating method according to the invention.

Referring to FIG. 6, the pressure regulating method according to an embodiment for the fuel injection system as per FIG. 5 will be described below. In a step A, a setpoint position of the leakage-prone volume flow regulating valve 312 is detected. In step C, an operating state of the internal combustion engine is detected. In step D, a fuel pressure in the high-pressure region downstream of the second fuel pump 306 is optionally detected. The pressure is preferably detected by means of the fuel pressure sensor 324 in the high-pressure fuel accumulator 318. In step C, the detection of a fuel temperature in the fuel injection system 3 takes place, preferably by means of the fuel temperature sensor 310 adjacent to the leakage-prone volume flow regulating valve 312.

The values detected in step C are transmitted to a control unit (not illustrated). The control unit evaluates the transmitted parameters. For this purpose, it is checked whether the volume flow regulating valve 312 is in a closed position. Furthermore, it is checked whether the operating state of the internal combustion engine corresponds to a first or a second predefinable operating state. With regard to the detected fuel pressure, it is checked whether it lies above a first predefinable threshold value or below a second predefinable threshold value. As a function of said check, the control unit actuates the first fuel pump in step B. The leakage-prone volume flow regulating valve 312 thus serves as the sole control element for a pressure regulation in the fuel injection system 3.

The above-described pressure regulating method will be described below on the basis of a specific example. Since the leakage behavior of the volume flow regulating valve 312 has an effect in particular in the case of injection rates of the fuel injection system 3 which are low in relation to full-load operation of the internal combustion engine, it is assumed that the operating state of the internal combustion engine has changed from full load to overrun operation.

As a position for the volume flow regulating valve 312, a closed setpoint position is detected. If only the position of the volume flow regulating valve is used for pressure regulation, then the first fuel pump 302 is either deactivated completely or is activated and deactivated in a time-controlled manner by means of "toggle" switching for as long as the volume flow regulating valve 312 is situated in the closed position. In the case of "toggle" switching, switching takes place exclusively between an off state and an on state. No other regulation of the first fuel pump 302 is provided. If, for example, the position of the volume flow regulating valve 312 now changes from closed to not closed, then the first fuel pump 302 is permanently activated.

If, in the above example, the operating state of the internal combustion engine is additionally detected, then the overrun phase is detected. In this case, the first fuel pump 302 is deactivated or is activated with the above-described "toggle" switching for as long as the detected operating state of the internal combustion engine corresponds to the overrun phase or the idle phase. The first fuel pump 302 is activated if the detected operating state of the internal combustion engine corresponds to a second predefinable operating state, for example load operation such as full load or part load, corresponding to certain injection rates.

As a fuel pressure in the high-pressure region, a value has been detected which lies above the first predefinable threshold value. The respective first and second predefinable threshold value is defined for example as a function of the operating state of the internal combustion engine and is stored in the control unit. Since the detected fuel pressure exceeds the first predefinable pressure threshold value, the first fuel pump is deactivated or actuated by means of the above-described "toggle" switching. If the fuel pressure falls below a second predefinable threshold value before the position of the volume flow regulating valve 312 or the operating state of the internal combustion engine changes, then the first fuel pump 302 is activated again. Until the first predefinable threshold value is reached again, the first fuel pump 302 may be permanently activated or actuated in the form of interval switching, in particular "toggle" switching.

By means of the fuel temperature detected in step C, it is furthermore possible for a leakage volume flow of the leakage-prone volume flow regulating valve to be determined when the leakage-prone volume flow regulating valve is situated in a closed state. The leakage volume flow determined on the basis of the fuel temperature is taken into consideration in the activation of the first fuel pump, which improves the accuracy of the pressure regulating method. It is preferably possible in this way for the time-controlled interval switching, in particular the "toggle" switching, to be set with greater accuracy with regard to the time intervals.

The invention claimed is:

1. A fuel injection system of an internal combustion engine, comprising:

a first and a second fuel pump, a leakage-prone volume flow regulating valve arranged in a fuel line between the first and the second fuel pump, a fuel temperature sensor measuring a fuel temperature downstream of the first fuel pump and upstream of the second fuel pump, and an automated control unit configured to actuate the first fuel pump as a function of a position of the leakage-prone volume flow regulating valve, a detected operating state of the internal combustion engine, and the measured fuel temperature, such that the leakage-prone volume flow regulating valve serves as the sole control element for a fuel pressure regulation operation in the fuel injection system, and wherein the control unit operates to deactivate the first fuel pump in response to detecting the operating state of the internal combustion engine corresponds to a first predefined operating state, and activate the first fuel pump in response to detecting the operating state of the internal combustion engine corresponds to a second predefined operating state different from the first predefined operating state.

2. The fuel injection system of claim 1, wherein the leakage-prone volume flow regulating valve is a slide-type volume flow regulating valve.

3. The fuel injection system of claim 1, wherein the first fuel pump is an in-tank electric pre-feed pump.

4. The fuel injection system of claim 1, wherein the second fuel pump is a plug-in pump configured to be lubricated by engine oil of the internal combustion engine.

5. The fuel injection system of claim 1, wherein the control unit is configured to actuate the first fuel pump as a function of a fuel pressure measured by a fuel pressure sensor.

6. A pressure regulating method for a fuel injection system comprising a first and a second fuel pump, a leakage-prone volume flow regulating valve arranged in a fuel line between the first and the second fuel pump, and a control unit configured to actuate the first fuel pump, the pressure regulating method comprising:

detecting a position of the leakage-prone volume flow regulating valve, detecting a fuel temperature downstream of the first fuel pump and upstream of the second fuel pump, detecting an operating state of the internal combustion engine, and actuating the first fuel pump as a function of the detected position of the leakage-prone volume flow regulating valve, the detected operating state of the internal combustion engine, and the detected fuel temperature, wherein the leakage-prone volume flow regulating valve serves as the sole control element for a fuel pressure regulation operation in the fuel injection system, and wherein the control unit operates to deactivate the first fuel pump in response to detecting the operating state of the internal combustion engine corresponds to a first predefined operating state, and activate the first fuel pump in response to detecting the operating state of the internal combustion engine corresponds to a second predefined operating state different from the first predefined operating state.

7. The pressure regulating method of claim 6, wherein the actuation of the first fuel pump comprises time-dependent toggle switching.

8. The pressure regulating method of claim 6, further comprising:

detecting a fuel pressure downstream of the second fuel pump, and wherein the function used to actuate the first fuel pump is further based on the detected fuel pressure.

9. The pressure regulating method of claim 8, comprising:

deactivating the first fuel pump in response to detecting an overshoot of a first predefined pressure threshold value, and activating the first fuel pump in response to detecting an undershoot of a second predefined pressure threshold value different than the first predefined pressure threshold value.

10. A control unit of a fuel injection system of a motor vehicle, the control unit being configured to perform a pressure regulating method including:

detect an operating state of the internal combustion engine; and actuate a first fuel pump of the fuel injection system as a function of the detected operating state of the internal combustion engine, a position of a leakage-prone volume flow regulating valve arranged in a fuel line between the first fuel pump and a second fuel pump, and a fuel pressure measured downstream of the first fuel pump and upstream of the second fuel pump, such that the leakage-prone volume flow regulating valve serves as the sole control element for a fuel pressure regulation operation of the fuel injection system, and wherein the control unit operates to deactivate the first fuel pump in response to detecting the operating state of the internal combustion engine corresponds to a first predefined operating state, and activate the first fuel pump in response to detecting the operating state of the internal combustion engine corresponds to a second predefined operating state different from the first predefined operating state.

11. The fuel injection system control unit of claim 10, wherein the control unit is configured to actuate the first fuel pump by time-dependent toggle switching.

12. The fuel injection system control unit of claim 10, wherein the control unit is configured to detect a fuel pressure downstream of the second fuel pump, and actuate the first fuel pump as a function of the detected fuel pressure.

13. The fuel injection system control unit of claim 12, wherein the control unit is configured to:

deactivate the first fuel pump in response to detecting an overshoot of a first predefined pressure threshold value, and activate a first fuel pump in response to detecting an undershoot of a second predefined pressure threshold value different than the first predefined pressure threshold value.

* * * * *